United States Patent [19]

Bourne, Jr. et al.

[11] 4,161,215

[45] Jul. 17, 1979

[54] SOLENOID OPERATED TUBING SAFETY VALVE

[75] Inventors: Henry A. Bourne, Jr., Ponca City, Okla.; Louis M. Ayers, Houston, Tex.; Minor R. Wiseman, Newkirk, Okla.

[73] Assignee: Continental Oil Company, Ponca City, Okla.

[21] Appl. No.: 848,800

[22] Filed: Nov. 7, 1977

Related U.S. Application Data

[63] Continuation of Ser. No. 617,116, Sep. 26, 1975, abandoned.

[51] Int. Cl.[2] ..... E21B 43/12

[52] U.S. Cl. ..... 166/65 M; 166/53; 166/332; 251/139

[58] Field of Search ..... 166/65 R, 65 M, 316, 166/332, 53, 72; 137/DIG. 10; 251/65, 137, 139, 140

[56] References Cited

U.S. PATENT DOCUMENTS

| | | | |
|---|---|---|---|
| 3,125,321 | 3/1964 | Domelen | 251/139 |
| 3,178,151 | 4/1965 | Caldwell | 251/139 X |
| 3,731,742 | 5/1973 | Sizer et al. | 166/65 M X |
| 3,762,683 | 10/1973 | Sangl | 251/139 |

*Primary Examiner*—Ernest R. Purser
*Attorney, Agent, or Firm*—Richard W. Collins

[57] ABSTRACT

A wireline retrievable, subsurface tubing safety valve that is opened and held open by the transmission of electric current from the surface. Interruption of the current supply results in automatic closure of the valve. The device includes a pressure equalizing valve which enables the valve to be opened against a high differential pressure.

15 Claims, 7 Drawing Figures

SOLENOID OPERATED TUBING SAFETY VALVE

This is a continuation of application Ser. No. 617,116, filed Sept. 26, 1975 and now abandoned.

BACKGROUND OF THE INVENTION

1. Field of the Invention

This invention relates to downhole safety valves for controlling the flow of fluids from wells. More particularly, the invention relates to safety valves which may be controlled from the surface and which also automatically close in response to a situation which would result in an oil spill or possibly a fire in the event of damage to equipment above the safety valve.

2. Description of the Prior Art

Oil and gas wells, particularly those located offshore, are susceptible to wellhead damage caused, for example, by violent storms, fires, collision with a vessel, or other accident or disaster. To prevent uncontrolled flow of fluids from the well through the damaged wellhead, it is common practice to install a downhole safety valve in the tubing through which the fluids are produced. Such safety valves are designed to be normally open so that well fluids may be produced therethrough. In response to some signal from the surface or to a change in flow conditions through the tubing, the valve can be closed to stop flow of fluid through the tubing. One popular type of safety valve used for this purpose utilizes a hydraulic line extending from the safety valve to the surface of the well. Hydraulic pressure is maintained in the line to hold the safety valve open, and in the event of accident the pressure in the control line is released and the safety valve automatically closes. These prior art subsurface safety valves controlled by hydraulic pressure have been widely used in the field, and generally operate satisfactorily. However, hydraulically controlled, subsurface, wireline or tubing retrievable tubing safety valves do have significant disadvantages. For example, if the control tubing leading to the subsurface valve is damaged, corroded, or otherwise leaks to permit reduction of the hydraulic control pressure, the safety valve will close in accordance with its "fail-safe design" and the well will be shut in. To restore production, the tubing must be pulled and the hydraulic control line replaced. If the wireline retrievable valve requires service due to failure, the valve must be retrieved, and this action permits pressure communication between the production tubing and the oil well casing annulus. This is hazardous in the case of high pressure wells as it allows high well pressure to be imposed on the casing annulus. A pack-off mandrel to seal the hydraulic port in the downhole safety valve could be run. Such a pack-off mandrel would in itself be an obstruction in the tubing which would have to be removed whenever it was necessary to conduct wireline operations below the safety valve. Upon removal of the pack-off mandrel, pressure communication between the production tubing and the casing annulus would necessarily result.

Another disadvantage to the use of hydraulically controlled, wireline retrievable, subsurface tubing safety valves is that extremely high hydraulic control pressures are sometimes required. This means that hydraulic control lines at the surface must carry high hydraulic pressure exceeding 10,000 psi in some cases. On offshore platforms particularly, these high hydraulic control pressures constitute a potential hazard to personnel working on the platform and around the wellhead.

Another widely used type of safety valve operates in response to excessive flow rates to automatically close the production tubing. This type of device has the disadvantage that it does not shut off the well in the event of damage to equipment above the safety valve unless the well is flowing at a rate sufficient to actuate the shutoff mechanism.

There has been a long standing need for a subsurface tubing safety valve which is reliable, which automatically closes in the event of damage to equipment regardless of the rate of flow through the tubing, and which is not subject to the disadvantage of allowing high tubing pressure to be communicated to the casing annulus. Such a device is provided by the present invention.

SUMMARY OF THE INVENTION

According to the present invention, a wireline retrievable, subsurface tubing safety valve is provided that is opened and held open by the transmission of electric current from the surface. Interruption of the current supply by the action of an operator or as a result of accidental damage to the well equipment above the safety valve results in automatic closure of the valve regardless of the rate of flow of fluid at the time. The safety valve of the invention comprises a sealed solenoid coil wound around a non-magnetic tube which also serves as part of the tubing string. The non-magnetic tube has a solenoid plunger and other valve parts which are suspended inside the tube from a conventional wire line locking and pack-off mandrel. The wire line pack-off mandrel locks in a special section of the tubing string, referred to as a landing nipple, above the safety valve, and a conduit containing electrical lead wires for carrying electric current to the solenoid is attached externally to the tubing string and extends from the solenoid to the surface where it terminates in a safety valve control housing. The safety valve of this invention includes means allowing the valve to be re-opened after an incident causing closure of the valve even though the pressure differential below and above the valve is such that the solenoid can not open the main valve against such pressure differential. Pressure equalizing valve means is incorporated in the safety valve to enable equalization of the pressure differential across the main valve to the extent that the main valve may be opened by the action of the solenoid to enable resumption of production through the safety valve.

It is an object of this invention to provide an electrically operated, wireline retrievable, subsurface tubing safety valve.

It is a further object to provide such a safety valve which has no potential for pressure communication between the production tubing and the casing annulus above the safety valve.

It is another object to provide such a safety valve which is independent of the flow rate or the shut-in pressure in the well tubing. It is still another object to provide such a safety valve which is simple and lends itself to easy incorporation with remote supervisory control systems.

The above objects, as well as additional objects and advantages, are provided by this invention as will be apparent from consideration of the following detailed description of preferred embodiments of the invention.

DESCRIPTION OF THE PREFERRED EMBODIMENTS

Figure 1:
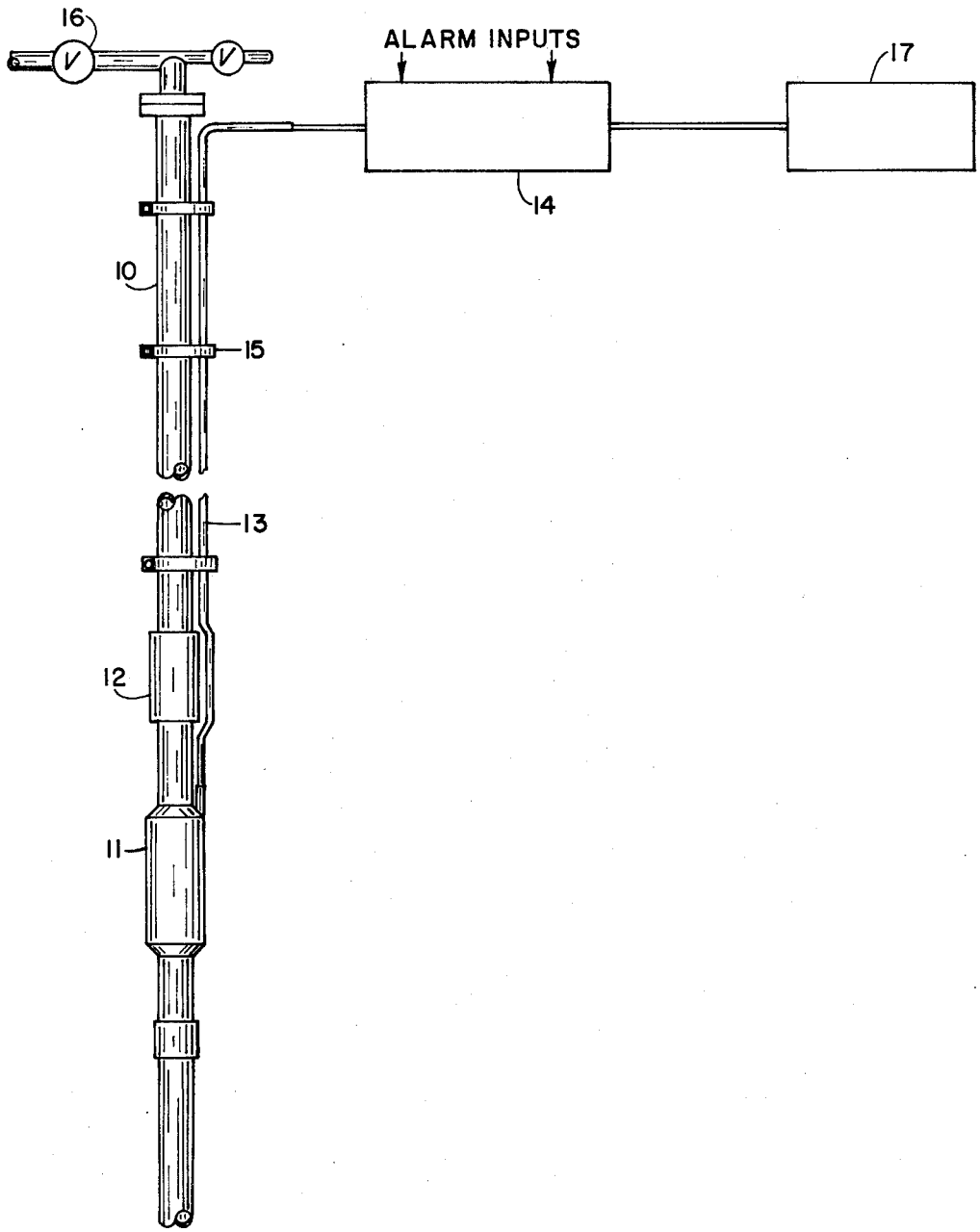
FIG. 1 is a schematic representation showing the relationship of the safety valve of the invention with a production tubing string and associated control equipment.

FIG. 1 illustrates the general arrangement of a subsurface safety valve in the tubing string of a producing well. As shown in FIG. 1, a tubing string 10 extends from a producing formation, and a solenoid tubing sub 11 containing the safety valve of the invention is attached as a part of the tubing string 10. A landing nipple 12 is incorporated in the tubing string 10 above the tubing sub 11, and supports a mandrel (not shown) which in turn supports the internal parts of the safety valve. A conduit 13 extends from the solenoid tubing sub 11 to a safety valve control housing 14 located above the surface. A series of clamps 15 hold the conduit 13 against the tubing string 10. A wing valve 16 is positioned in the flow line as a part of the "Christmas tree" for selectively producing or closing in the well. The solenoid coil of the safety valve of the invention is energized by a direct current power supply 17. The direct current power source may be batteries, alternating current acting through a rectifier, or a combination thereof.

Figure 2:
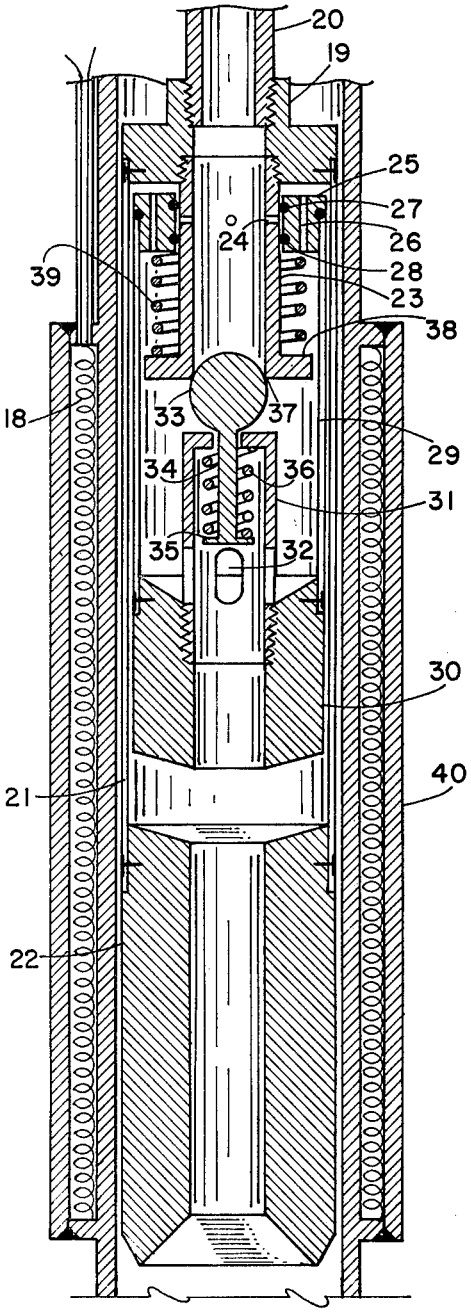
FIG. 2 is a sectional view of a preferred embodiment of the invention illustrating the safety valve in the closed position.
Figure 3:
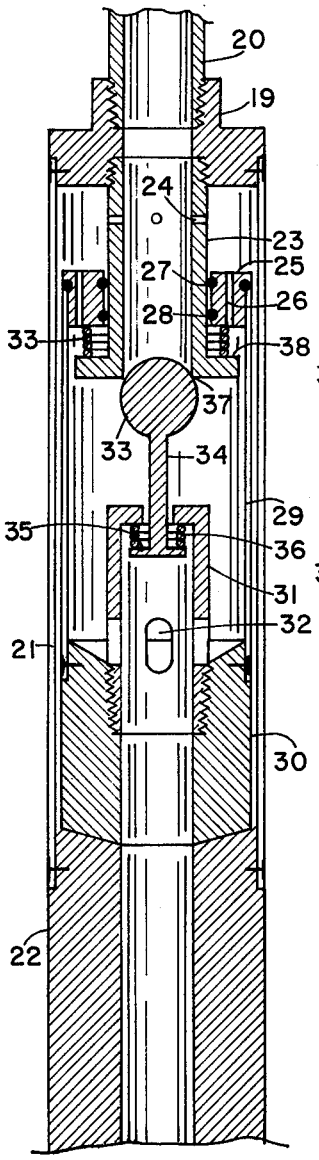
FIG. 3 is a sectional view of the safety valve shown in FIG. 2, illustrating the operation of the pressure equalizing valve means as the well is being returned to production following closure of the safety valve.
Figure 4:
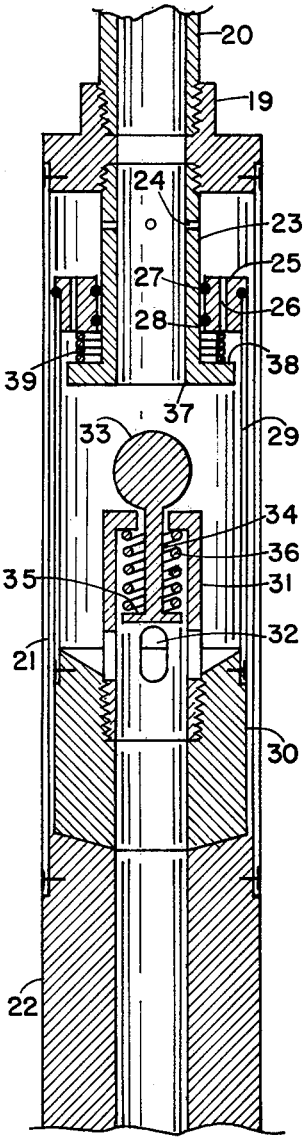
FIG. 4 is a sectional view of the safety valve shown in FIGS. 2 and 3, illustrating the relationship of the internal parts of the safety valve during normal production of fluid through the tubing string.

The most preferred embodiment of a subsurface safety valve of this invention is illustrated in FIGS. 2 through 4.

As shown in FIG. 2, solenoid tubing sub 11 houses solenoid windings 18 about a substantial portion of the length of solenoid tubing sub 11. A mandrel 19 is contained within the upper portion of tubing sub 11 and attached to a conduit 20 which in turn is supported from the leading nipple 12 shown in FIG. 1. A plunger top sleeve 21 is fixed to mandrel 19 and extends downwardly through tubing sub 11, and is fixed at its lower end to a plunger stop member. Mandrel 19 also supports a flow tube 23 having pressure equalizing ports 24 therein. Pressure equalizing valve means 25 having small conduits 26 therethrough slidably encompasses flow tube 23 and includes upper sealing ring 27 and lower sealing ring 28, which sealing rings, when the pressure equalizing valve means is in the position illustrated in FIG. 2, straddle the pressure equalizing ports 24 to prevent flow of fluid through same. A plunger sleeve 29 is affixed to equalizing valve 25 and depends therefrom within plunger stop sleeve 21, and is affixed to a solenoid plunger 30 at its lower end. A main valve guide 31 having guide ports 32 extends upwardly from solenoid plunger 30, and supports and guides main valve 33. Main valve 33 includes a depending member 34 terminating in shoulder 35. A spring 36 within main valve guide 31 biases main valve 33 in a lower position as illustrated in FIG. 2. As shown in FIG. 2, when solenoid plunger 30 is in the raised position relative to plunger stop member 22, main valve 33 is seated against valve seat 37 in the lower portion of flow tube 23. In the position shown in FIG. 2, both main valve 33 and equalizer valve 25 are in the closed position, such that no fluic can flow from below tubing sub 11 to the mandrel 19 and the portion of the tubing string above the safety valve. Flow tube 23 includes a shoulder 38, and a spring 39 between flow tube shoulder 38 and equalizer valve 25 biases equalizer valve 25 toward an upper position as illustrated in FIG. 2. Conduit 13 extends from tubing sub 11 and contains electrical leads for conducting current from power supply 17 (FIG. 1) to solenoid windings 18.

The solenoid tubing sub 11 is constructed of a non-magnetic alloy such as stainless steel, monel, or other non-magnetic alloy to allow the magnetic flux produced by the solenoid windings 18 to penetrate the tubing sub wall and magnetize the plunger stop member and the solenoid plunger. An outer jacket 40 comprised of a magnetic material surrounds the solenoid winding and protects it from well fluids and also provides a return path for the magnetic flux generated by the solenoid winding when direct current is allowed to flow in the winding. With the exception of the jacket 40, the plunger stop member 22 and plunger 30, all of the components of the safety valve are preferably made from non-magnetic alloys. The plunger stop member 22 and the plunger 30 are preferably made of an alloy having high permeability, low hysteresis, and low residual magnetism. Such alloys produce a high plunger attraction with low amperage in the solenoid and yet exhibit low residual magnetism when there is no magnetizing current flowing in the solenoid winding.

The operation of the safety valve shown in FIGS. 2 through 4 will now be described. FIG. 2 depicts the safety valve within the solenoid winding with no current flowing. Main valve 33 is closed against main valve seat 37 and equalizer valve spring 39 exerts upward loading on equalizer valve 25 so that the two sealing rings 27 and 28 straddle the equalizing ports 24. With the valve in the closed position as shown in FIG. 2, there is likely to be a higher pressure in the tubing below the valve than in the tubing above the valve. Excessive force would be required to move main valve 33 away from main valve seat 37 with a high differential pressure across the valve. That is, the magnetic force generated by the solenoid winding would not be sufficient to pull the main valve 33 down against the upward force of the fluid pressure in the lower part of the tubing string. Accordingly, when the well is to be returned to production following a shutdown of the safety valve for any reason, it is usually first necessary to equalize the pressure across the main valve before opening it. This is done by action of the equalizing valve 25 as follows. The application of direct current to the solenoid winding 18 produces a strong magnetic field in the center of the solenoid, which magnetizes plunger stop member 22 and plunger 30, thereby producing a strong attractive force between the two members which greatly increases as the distance between the two members decreases. The attractive force on plunger 30 causes it to move down, which simultaneously moves plunger sleeve 29 and equalizer valve 25 downward while compressing equalizer valve spring 39 and main valve spring 36 as best illustrated in FIG. 3. In this position, well fluid may flow through conduits 26 in equalizing valve 25 and then out through equalizing ports 24 as shown in FIG. 3. Main valve 33 remains closed against main valve seat 37 until the pressure differential across the main valve has been reduced to a level at which main valve spring 36 is able to expand and force main valve 33 away from valve seat 37 to the position shown in FIG. 4. In order for the equalizing valve 25 to be effective, it is generally necessary to close wing valve 16 (FIG. 1). With the well shut in at the surface by wing valve 16, the pressure in the tubing above the safety valve will rapidly approach the pressure in the tubing below the main valve. The time required for pressure equalization will depend on the initial pressure differential and the size and number of equalizing ports 24 in flow tube 23. When the pressure differential across main valve 33 is nearly equalized, main valve spring 36 will cause main valve 33 to move away from its seat 37 and the safety valve will be fully open. The wing valve 16 (FIG. 1) can then be opened and the well can be produced normally. Any interruption in the low electrical current supplied to the solenoid will cause the magnetic field to collapse, and the magnetic force attracting plunger 30 to plunger stop member 22 will dissipate. Equalizer valve spring 39 will then move plunger 30, plunger sleeve 29, and equalizer valve 25 to the upper position shown in FIG. 2 causing main valve 33 to contact main valve seat 37 and also causing pressure equalizing ports 24 to be sealed by upper and lower sealing rings 27 and 28 respectively.

Numerous adavantages are provided by the safety valve of this invention as compared to prior art safety valves. The operation of the safety valve of this invention is "fail safe", in that a disruption of current to the solenoid winding results in the safety valve automatically closing. A particular advantage of the safety valve of the invention compared to prior art safety valves which relied upon hydraulic pressure to maintain them in the open position is that there is no "hole in the tubing" which could result in dangerous high pressure being communicated to the casing annulus in the event of a failure in the hydraulic pressure line serving the safety valve. Still another important advantage is that the safety valve of the invention has a "self equalizing" provision, such that the solenoid does not need to overcome the pressure differential across the main valve after closure of the main valve. Other advantages provided by the invention are that no high hydraulic control pressure lines are needed, no permanently installed wearing parts are required, and the device is very adaptable to remote supervisory control and to inexpensive surface control hookups. Further, the valve as described in FIGS. 2 through 4 requires very little power consumption, as a current of about 5 amperes is sufficient to hold the valve in the equalizing position shown in FIG. 3, and a current of about one half ampere is sufficient to maintain the valve in the open position as shown in FIG. 4. Thus, only about 20 watts of power is required to maintain the valve open once flow has been established in the well.

Figure 5:
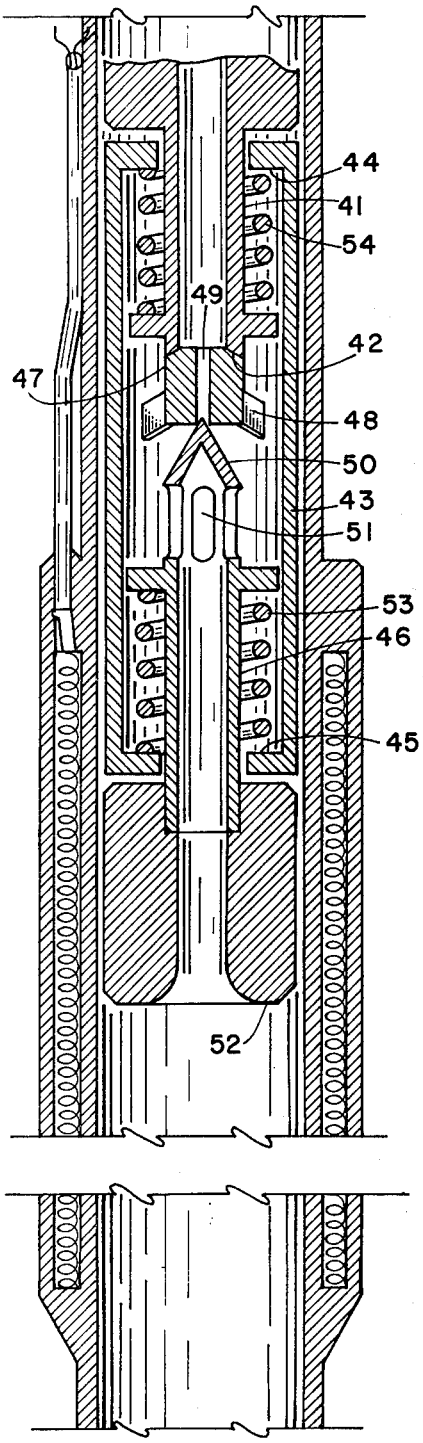
FIG. 5 is a sectional view of another embodiment of a safety valve according to the invention, showing the safety valve in the closed position.
Figure 6:
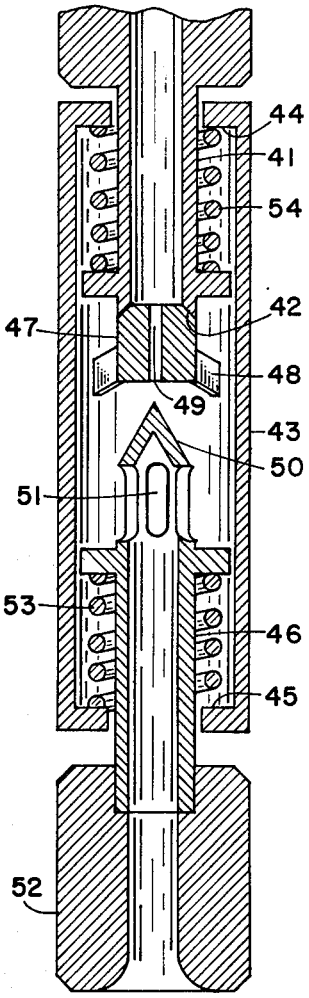
FIG. 6 is a sectional view of the safety valve of FIG. 5, showing the operation of the pressure equalizing valve upon resuming production of flow after closure of the valve.
Figure 7:
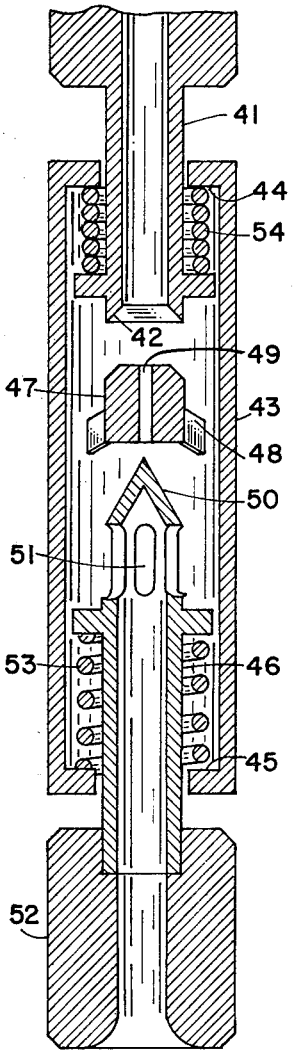
FIG. 7 is a sectional view of the safety valve shown in FIGS. 5 and 6, showing the relationship of the valve parts during normal production of fluid through the valve.

A modified version of a safety valve in accordance with the invention is depicted in FIGS. 5 through 7. The valve shown therein is arranged as shown in FIG. 1 with respect to the tubing string and the aboveground equipment. As with the valve shown in FIGS. 2 through 4, this embodiment also includes a solenoid tubing sub 11, solenoid winding 18, tubing sub outer jacket 40, conduit 13, and a mandrel 19 supported by a landing nipple 12 (not shown in FIG. 5). The remaining parts of this embodiment of the invention, and their operation, will now be described.

As shown in FIGS. 5 through 7, a flow tube 41 extends downwardly from mandrel 19 and terminates in main valve seat 42. A sleeve 43 is provided with upper shoulder 44 and lower shoulder 45, and the upper end of sleeve 43 is slideably positioned over mandrel flow tube 41. The lower end of sleeve 43 is slideably positioned over a plunger flow tube 46. Main valve 47 is fixed to sleeve 43 by support arms 48 so that main valve 47 travels longitudinally within tubing sub 11 with sleeve 43. Main valve 47 includes an equalizer port 49 therethrough, and equalizer valve 50 is provided at the upper end of plunger tube 46 for seating in the equalizer port 49 in main valve 47. Flow ports 51 are provided in the upper end of plunger flow tube 46. The lower end of plunger flow tube 46 is attached to solenoid plunger 52, and the solenoid plunger 52 is spring biased by spring 53 to an upper position relative to sleeve 43. An upper spring 54 biases sleeve 43 to an upper position relative to mandrel flow tube 41. When the solenoid winding 18 does not have current passing through it, solenoid plunger 52 is not pulled downwardly and springs 53 and 54 result in the valve being in the configuration depicted in FIG. 5. As shown in FIG. 5, main valve 47 is seated against main valve seat 42, and equalizer valve 50 is seated in equalizer port 49 such that no fluid passes through mandrel flow tube 41.

The operation of the safety valve shown in FIGS. 5 through 7 is quite similar to the operation previously described for the safety valve described in FIGS. 2 through 4. From the closed position depicted in FIG. 5, when current is passed through solenoid winding 18, solenoid plunger 52 is pulled downwardly by magnetic force to the position shown in FIG. 6. The force of the solenoid winding is not sufficient to overcome the pressure differential across main valve 47, but it is sufficient to pull equalizer valve 50 away from equalizer port 49 such that the pressure differential across main valve 47 can be equalized as described previously. When the pressure has built up in the tubing above the safety valve, because of well flow valve 16 being closed, the pressure differential across main valve 47 is soon equalized, such that the thrust produced in plunger 52 by the magnetic field of the solenoid winding will cause sleeve 43 to move downward against upper spring 54 causing main valve 47 to move away from main valve seat 42 and open fully as shown in FIG. 7. When the valve is fully open as shown in FIG. 7, well production may be resumed by opening wing valve 16 at the wellhead. Production flow will then commence, and the safety valve will remain open during normal production operations, providing that the flow of electrical current to solenoid winding 18 is not interrupted. Any interruption of the current to the solenoid, either by intentional act or by accident, will cause the magnetic field to dissipate, with the result that plunger 52 will be forced by springs 53 and 54 to the position shown in FIG. 5 to close the main valve and the equalizer valve.

In the event that the safety valves described above are to be removed from the tubing string for any reason, they may be retrieved by wire line operation in a manner well known in the art. The hardware for wire line retrieval and for positioning the equipment in the landing nipple 12 do not constitute a part of the invention, as such technology is old and well understood by those skilled in the art.

The foregoing description of two preferred embodiments of the invention is exemplary , and it will be appreciated that numerous variations and modifications could be made without departing from the true scope of the invention, which provides a subsurface safety valve for use in a tubing string in a well producing fluid from a subterranean formation, which safety valve is controlled by a solenoid which is operated at low current and low voltage, which does not present the potential hazard of pressure communication between the production tubing and the surrounding casing annulus, and which includes pressure equalization means in order that the safety valve may be returned to a flowing mode of operation in spite of a high pressure differential across the main valve portion thereof.

We claim:

1. A safety valve for use in a string of tubing extending into a borehole for production of fluid from a subterranean formation comprising:

(a) a non-magnetic tube means having fluid passage means therein and adapted for use as part of a tubing string;

(b) a solenoid coil wound around a portion of said tube means;

(c) mandrel means within and attached to said tubing string above said non-magnetic tube means, said mandrel means attached to and carrying sleeve means extending into said non-magnetic tube means, said sleeve means, at the lower end thereof, attached to a plunger stop means;

(d) flow tube means attached to said mandrel means and having pressure equalizing port means therein and main valve seat means at the lower end thereof;

(e) plunger tube means within said sleeve means and having a plunger of magnetizable material attached to the lower end thereof, said plunger and plunger tube being longitudinally movable within said non-magnetic tube means in response to operation of said solenoid coil;

(f) equalizing valve means attached to the upper end of said plunger sleeve encircling said flow tube means and adapted, when in an upper position, to seal off said pressure equalizing ports, and when in a lower position, to provide for flow of fluid from within said plunger tube to said pressure equalizing ports;

(g) resilient means biasing said plunger, plunger sleeve and equalizing value means in a normally upper position relative to said mandrel means; and (h) main valve guide means attached to said plunger, main valve means supported by said main valve guide means and adapted to seat in said main valve seat when said plunger is in an upper position, said main valve means being biased in a position away from said main valve seat to normally permit flow of fluid through said flow tube means when said plunger is in a lower position.

2. The safety valve of claim 1 including electrical leads extending from said solenoid coil.

3. The safety valve of claim 2 wherein said electrical leads are connected to a surface located power supply.

4. The safety valve of claim 1 wherein said plunger stop means has an axial flow port therethrough, said plunger means has a matching flow port therethrough, and said main valve guide means includes flow passage ports providing for fluid flow from said plunger means into said plunger sleeve means.

5. The safety valve of claim 1 wherein, when said solenoid coil is not energized, said main valve means and said equalizing pressure port means are closed.

6. The safety valve of claim 1 wherein, when said solenoid coil is energized, said plunger means is seated against said plunger stop means, and said main valve means is seated against said main valve seat when the pressure differential between fluid in the plunger sleeve means and the flow tube means is sufficient to overcome the bias of said main valve away from said main valve seat.

7. The safety valve of claim 1 wherein said plunger stop means is made of magnetizable material.

8. The safety valve of claim 1 wherein said safety valve is attached to a tubing string in a borehole as an intermediate part thereof, and electrical leads extend from said solenoid coil to a surface mounted power supply.

9. The safety valve of claim 1 wherein said equalizing valve means is spring biased in a normally upper position and said main valve means is spring biased in a normally lower position.

10. The safety valve of claim 1 wherein said equalizing valve means includes upper and lower sealing means adapted to straddle said equalizing port means when said equalizing valve means is in its upper position.

11. A safety valve for a tubing string comprising:

(a) a tubing sub adapted to be used as a part of said tubing string;

(b) a solenoid coil wound around a portion of said tubing sub;

(c) a mandrel adapted for attachment to said tubing string and having main valve seat means thereon;

(d) a solenoid plunger movable from a lower to an upper position in response to operation of said solenoid coil;

(e) main valve means responsive to movement of said solenoid plunger; and (f) pressure equalizing valve means adapted to allow flow of fluid into said tubing string above said safety valve when said main valve is closed and said solenoid plunger is in a lower position relative to said mandrel.

12. A safety valve as defined in claim 11 wherein said main valve means and said pressure equalizer valve means are both closed when said solenoid plunger is in an upper position.

13. A safety valve as defined in claim 12 wherein said main valve means is attached to and surrounded by a sleeve, said sleeve including spring biasing means in the upper end thereof urging said main valve means toward a closed position.

14. A safety valve as defined in claim 11 wherein a plunger stop member is provided below said solenoid plunger and in a fixed position relative to and surrounded by said solenoid coil.

15. A safety valve as defined in claim 14 wherein said plunger stop member is made of magnetizable material.

* * * * *